US005809764A

United States Patent [19]

Baba

[11] Patent Number: 5,809,764

[45] Date of Patent: Sep. 22, 1998

[54] PIECING METHOD FOR A SPINNING MACHINE

[75] Inventor: Kenji Baba, Kyoto, Japan

[73] Assignee: Murata Kikai Kabushiki Kaisha, Kyoto, Japan

[21] Appl. No.: 771,155

[22] Filed: Dec. 20, 1996

[30] Foreign Application Priority Data

Jan. 30, 1996 [JP] Japan ..... 8-013641

[51] Int. Cl.[6] ..... D01H 13/26; D01H 5/28

[52] U.S. Cl. ..... 57/261; 57/263; 57/315

[58] Field of Search ..... 57/261, 263, 279, 57/280, 328, 333, 350, 315, 318

[56] References Cited

U.S. PATENT DOCUMENTS

| | | | |
|---|---|---|---|
| 4,543,776 | 10/1985 | Seiki et al. | 57/261 |
| 5,175,982 | 1/1993 | Stahlecker | 57/261 X |
| 5,359,758 | 11/1994 | Stahlecker et al. | 57/261 X |
| 5,511,373 | 4/1996 | Banba | 57/261 |
| 5,619,848 | 4/1997 | Costales | 57/261 |

FOREIGN PATENT DOCUMENTS

| | | | |
|---|---|---|---|
| 448518 | 9/1981 | European Pat. Off. | 57/261 |
| 404209170 | 7/1992 | Japan | 57/261 |

*Primary Examiner*—C. D. Crowder
*Assistant Examiner*—Tina R. Taylor
*Attorney, Agent, or Firm*—Armstrong, Westerman, Hattori, McLeland & Naughton

[57] ABSTRACT

A piecing method for a spinning machine wherein, following stoppage of the spinning operations, after cutting the sliver (S) between the usually rotating draft rollers (13) and the stopped draft rollers (12) and before the restarting of drafting and spinning, the sliver (S) is once again cut between the usually rotating draft rollers (13) and the stopped draft rollers (12) by driving the stopped draft rollers (12) for a predetermined period of time and then stopping again, thus sliver (S) is supplied to the twisting part (2) by then driving the stopped draft rollers (12). Therefore, not only can the sliver fiber density of the sliver end supplied to the piecing area during piecing be increased, but that length of the tip of the sliver can also be shortened. Accordingly, the strength of the piecing part is increased and the length of the piecing part can be shortened.

8 Claims, 11 Drawing Sheets

FIG. 8(a)
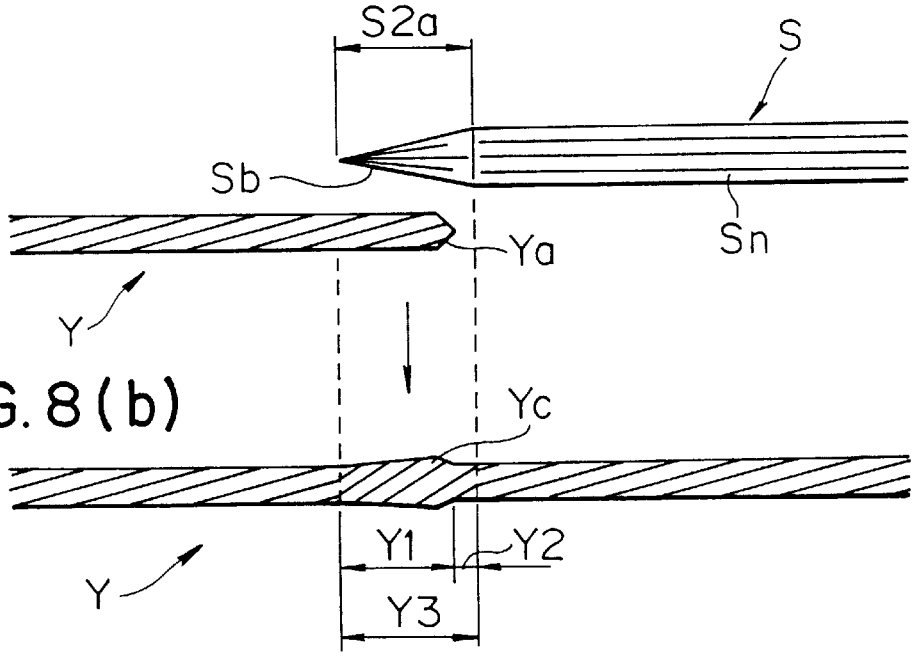
FIG. 8(b)
FIG. 9(a)
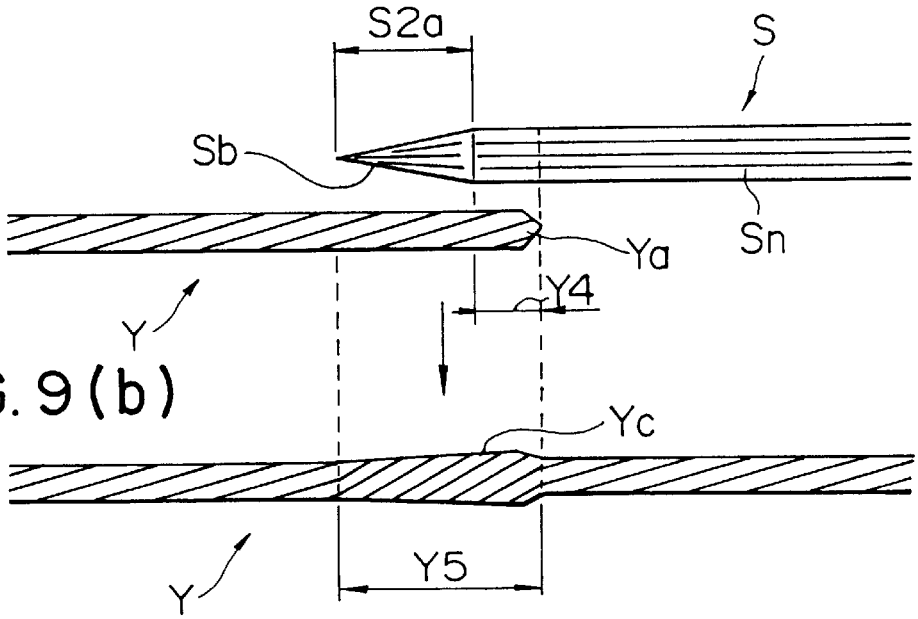
FIG. 9(b)

FIG. 12 (a) PRIOR ART

FIG.12 (b) PRIOR ART

PIECING METHOD FOR A SPINNING MACHINE

TECHNICAL FIELD

The present invention relates to a piecing method for joining broken yarn on a spinning machine having a draft part and a twisting part.

BACKGROUND OF THE INVENTION

The general piecing method for a spinning machine for joining a newly spun yarn (upper yarn) and a winding side yarn (lower yarn) uses a knotter or a splicer or the like. Recently however, instead of this piecing method for joining these yarns, a piecing method has been developed that guides the winding side yarn end into a spinning nozzle of the twisting part of the spinning machine and afterwards, joins the ends of the sliver supplied into the spinning nozzle and the winding side yarn ends guided into the spinning nozzle by a spinning process as a result of the restarting of spinning.

Below, using FIG. 11, which is a time chart showing an inter-relationship between a back roller control signal, a spinning control signal and a sliver fiber density, and other appropriate drawings, a conventional piecing method for a spinning machine will be described.

Firstly, using FIG. 2, one example of a spinning machine to which a piecing method has been applied will be described.

Numeral 1 indicates a draft device showing a four-line type draft device as an example. The draft device 1 comprises the four lines including back rollers 11, third rollers 12, middle rollers 13 attached with an apron belt and front rollers 14. Numeral 10 indicates a sliver guide. Of these, the middle rollers 13 and the front rollers 14 are respectively attached to line shafts common with each spinning unit arranged in parallel on the spinning machine. All units are usually driven simultaneously but the back rollers 11 and the third rollers 12 can be individually driven and stopped for each unit. In short, the rotation of a line shaft 15 is transmitted to a unit shaft 19 via gears 16,17 arranged on each unit and a suitable clutch 18, such as an electric clutch formed with a brake and the back rollers 11 and the third rollers 12 are driven at a predetermined peripheral velocity ratio by the belt 20 wound between the pulley 19*p* attached to one end of the unit shaft 19 and the pulleys 11*p*, 12*p* attached to each rotation shaft of the back rollers 11 and the third rollers 12. Each unit can be forcibly stopped by operating the brake and release of the clutch 18. A width condensor 48 that restricts the width of the sliver S is fixed by a fixed plate (not shown in the drawing) between the third rollers 12 and the middle rollers 13.

The twisting device 2 comprises mainly an air spinning nozzle 21 which produces a spinning air current by the blowing of pressured air, a nozzle block 22 which supports the nozzle 21, a spindle (yarn guide tube) 23 having an insertion hole 23*b* and of which the tip 23*a* is positioned inside the aforementioned air spinning nozzle 21, and a spindle support member 24. The inner part 21*a* of the air spinning nozzle 21 is the piecing area where joining of the fiber comprising the sliver S supplied to the inner part 21*a* of the air spinning nozzle 21, and the winding side spun yarn Y inserted into the insertion hole 23*b* of the spindle 23 and guided into the inner part 21*a* of the air spinning nozzle 21 is carried out.

A plurality of air blowing holes 30 for generating a rotating air current are arranged in the air spinning nozzle

21. Numeral 31 indicates an air chamber formed between the nozzle block 22 and the spindle support member 24. The air chamber 31 is connected to an air suction source (not shown in the drawing) that sucks air at a low suction pressure via the suction hole 40 and during spinning, acts as an exhaust hole for the air blown from the air blowing holes 30 of the air spinning nozzle 21 as well as removing fly fiber waste, and the like, generated inside the air chamber 31 during spinning. It should be noted that, in the said twisting device 2, the spindle 23 is fixed to the spindle support member 24 but, via a suitable bearing, can also be rotatable.

Numeral 41 indicates a cylinder. A lower frame 44 of the spindle support member 24 is attached to the tips of the piston rods 42,43 of the cylinder 41. Accordingly, by operating the cylinder 41 and moving the spindle support member 24 to the left and right, the spindle support member 24 is able to separate from, or couple with the nozzle block 22. Numeral 47 indicates a fly waste suction pipe connected to the air suction source (not shown in the drawing) and is for sucking and removing fly waste.

Next, the conventional piecing method for the spinning machine will be described. It should be noted that the horizontal axis of FIG. 11 shows the time (timing) and the vertical axis shows respectively the back roller control signal, the spinning control signal and the sliver fiber density. Also, the "1" of the back roller control signal indicates an ON signal to the clutch 18; in short, "driving of the back rollers and third rollers". "0" indicates an OFF signal to the clutch 18; in short, "stoppage of the back rollers and the third rollers". Furthermore, "1" of the spinning control signal indicates "spinning in operation"; in short, the signal of rotating air current generation in the inner part 21*a* of the air spinning nozzle 21. "0" of the spinning control signal indicates "stoppage of spinning"; in short, a signal of rotating air current stoppage in the inner part 21*a* of the air spinning nozzle 21. The sliver fiber density indicates the fiber density of the sliver S at the position of the width condensor 48 positioned between the third rollers 12 and the middle rollers 13. As used herein, the expression, "fiber density" refers to the weight of fiber contained in a unit length of sliver. Thus, "normal fiber density" refers to a sliver containing, for example, about 100 fibers per unit length. In this example, a "near normal fiber density" is less than "normal fiber density" having less than 100 fibers per unit length and above about 50 fibers per unit length; and "rough fiber density" designates a sliver that, in the example, is incapable of resisting an anticipated tension load and contains less than about 50 fibers per unit length.

Below, based on the time being the horizontal axis of FIG. 11, the conventional piecing method for the spinning machine will be described.

(Operating state at times t0–t1)

At times t0–t1, the back roller control signal is "1" (A0, A) and the spinning control signal is also "1" (10, I). The sliver fiber density is fixed at a2 (E0, E). Times t0–t1 indicate the normal spinning operating state where the draft device 1 and the twisting device 2 are operating and the unit of the spinning machine is spinning the yarn Y. The fixed sliver fiber density a2 indicates that the sliver S supplied to the unit of the spinning machine in the normal operating state is passing through the width condenser 48 in a fixed "normal fiber density" state.

(Operating state at time t1)

Time t1 shows the state where the back roller control signal switches from "1" to "0" (A, B). Conversely, the spinning control signal is the same as before, being at "1" (10, I). Further, at time t1, the sliver fiber density is at "normal fiber density" a2 (E) but afterwards, starts reducing. Time t1 indicates when a yarn breakage has occurred, when the yarn has been forcibly broken due to the detection of a yarn fault such as slub, or the like, or when a full package is to be doffed.

The operations of the spinning machine at time t1 will be described with reference to FIG. 2. When a yarn breakage has occurred, a detection signal is sent from the detection sensor (not shown in the drawing) and, together with this, a stop signal is sent to the clutch 18 connected to the back rollers 11. In connection with the releasing of the clutch 18, the brake connected with it operates and the rotation of the unit shaft 19 stops. Due to this, the back rollers 11 and the third rollers 12 are forcibly stopped and the supply of the sliver S is stopped. The twisting device 2 continues operating as before. The sliver S does not quickly break between the stopped third roller 12 and the rotating middle roller 13 and, as will be described later, gradually pulls apart. It should be noted that FIG. 2 shows the state immediately after the sliver S has broken between the stopped third roller 12 and the middle roller 13 which continues to rotate.

(Operating state at times t1–t2)

At times t1–t2, the back roller control signal is "0" (B, C) and the spinning control signal is unchanged at "1" (I0, I). However, the fiber density of the sliver S becomes gradually lower from the "normal fiber density" a2 during drafting (E, F). The spinning machine operations at times t1–t2 will be described with reference to FIG. 2. From the point at time t1, due to the stopped back rollers 11 and third rollers 12 and the still-rotating middle rollers 13, the sliver S between the third rollers 12 and the middle rollers 13 is gradually pulled by the still-rotating middle rollers 13 while a gap is generated between the fibers comprising the sliver S. Further, the fiber density of the sliver S which has started to be pulled becomes gradually lower from the "normal fiber density" a2 during drafting. The sliver S between the stationary third roller 12 and the still-rotating middle roller 13 gradually becomes a tapered shape. It should be noted that the twisting device 2 continues operating as before.

FIG. 6 is an expanded view of the sliver S shown in FIG. 2 between the third rollers 12 and the middle rollers 13. As shown in FIG. 6, the tip of the Sn part of the sliver S upstream (silver guide 10 side) from the nip point of the third rollers 12 is gripped by the stopped third rollers 12. The Sm part of the sliver S positioned downstream from the width condensor 48 is gripped by the still-rotating middle rollers 13 and transported to the left as seen from the drawing. As a result, the fibers of the sliver S positioned between the third rollers 12 and the middle rollers 13 are gradually pulled and at times t1–t2, the length S1 part of the sliver S positioned between the third rollers 12 and the middle rollers 13 is gradually formed into a tapered shape.

(Operating state at time t2)

At time t2, the back roller control signal is "0" as before (B, C) but the spinning control signal changes from "1" to "0" (I, W). Further, the reduced sliver fiber density is at a1 (F). The fibers of the sliver S, which are continuously being pulled by the stopped back rollers 11 and third rollers 12 and the still-rotating middle rollers 13 are pulled apart between the third rollers 12 and the middle rollers 13. Furthermore, at time t2, the operation of the twisting device 2 stops and spinning stops. In comparison with the "normal fiber density" a2 of the sliver S, the tip Sa of the sliver S pulled into a tapered shape becomes a1 being the sliver fiber density where fibers are greatly insufficient.

An expanded drawing of the tip Sa of the sliver S pulled apart at time t2 is shown in FIG. 6. The tip Sa of the sliver S pulled apart forms a tapered shape towards the tip Sa as the fibers are randomly pulled while gaps are being created between the fibers and the fiber density gradually decreases. The sliver fiber density of the vertical axis shown in FIG. 11 is the fiber density at the width condenser 48 as described above, thus the sliver fiber density of the tip Sa of the sliver S at the width condensor 48 position is a1. The Sn part of the sliver S upstream (sliver guide 10 side) of the nip point of the third rollers 12 is the "normal fiber density" a2. In comparison with the sliver fiber density a2 of the part Sn, the sliver fiber density a1 of the tip Sa is the sliver fiber density where fibers are greatly insufficient and the so-called tip Sa is in the "rough state". Furthermore, the length S1 of the tip Sa is greatly extended. It should be noted that the part Sm of the pulled apart sliver S passes the normally rotating front rollers 14 and the twisting device 2 being in the operating state of before time t2 and is ejected by a suction means arranged near the yarn defect detector.

(Operating state at times t2–t3)

At times t2–t3, the back roller control signal is at "0" as before (B, C) and the spinning control signal is also at "0" (W, X). Furthermore, the sliver fiber density of the tip Sa of the sliver S positioned in the width condensor 48 is at the sliver fiber density a1 of the "rough state" where fibers are greatly insufficient (F, G). The back rollers 11 and the third rollers 12 are stationary, the supply of the sliver S has stopped and accordingly, the pulled apart sliver S also stops. In this way, at times t2–t3, as the back rollers 11 and the third rollers 12 are stationary, the part Sn of the sliver S is gripped by the third rollers 12 and the position of the tip Sa of the sliver S is as the state shown in FIG. 6. The twisting device 2 is stationary and spinning has stopped.

As shown in FIG. 3, at times t2–t3, the cylinder 41 is operated and the piston rods 42,43 advance. Due to this, the lower frame 44 moves to the left, as shown in FIG. 3, from the state in FIG. 2 and the spindle support member 24 and the spindle 23 separate from the nozzle block 22 and the air spinning nozzle 21. In continuance, the yarn end Ya of the winding side spinning yarn Y is reverse inserted from the ejection side of the spun yarn Y into the insertion hole 23*b* of the spindle 23 separated from the air spinning nozzle 21 by a device not shown. The yarn end Ya of the spun yarn Y, which has been inserted in the insertion hole 23*b* of the spindle 23 separated from the nozzle block 22 and the air spinning nozzle 21 and which hangs down by a predetermined length from the tip 23*a* of the spindle 23, is sucked into the suction pipe 45 and held at a predetermined tension. Next, from this state, the cylinder 41 is operated, the piston rods 42,43 retracted and the spindle support member 24 and the spindle 23 positioned on the lower frame 44 is once again moved to the right of FIG. 3.

The aforementioned suction pipe 45 is connected to an air suction source (not shown in the drawing). When yarn piecing is carried out, the suction pipe 45 sucks the yarn end Ya of the spun yarn Y inserted in the insertion hole 23*b* of the spindle 23 and pulled from the tip 23*a* of the spindle 23 and has a function that grips the yarn by a suitable tension. In the present device, as shown in FIG. 3, the suction pipe 45 is positioned so that the tip 45*a* of the suction pipe 45 is positioned below the tip 23*a* of the spindle 23 when the spindle 23 is separated from the air spinning nozzle 21, but if positioned such that suction of the yarn end Ya of the spun yarn Y pulled from the tip 23*a* of the spindle 23 is possible, any position is suitable. It should be noted that 46 is a support block in which is arranged the suction hole 40.

Then, as shown in FIG. 4, the nozzle block 22 and the spindle support member 24 are recoupled and the spindle 23 is returned to it's original position. At this point, the spun yarn Y inserted in the insertion hole 23*b* of the spindle 23 is bent and held in the suction pipe 45 when the spindle support member 24 and the nozzle block 22 are coupled. As a slit 33 is arranged in the side wall of the nozzle block 22 side of the spindle support member 24 and a slit 32 is arranged in the spindle support member 24 side of the nozzle block 22 opposite the slit 33 of the spindle support member 24, when the nozzle block 22 and the spindle support member 24 are coupled, the yarn end Ya of the spun yarn Y hanging from the tip 23*a* of the spindle 23 and held in the suction pipe 45, is inserted in the slits 32,33. Accordingly, the aforementioned yarn end Ya of the spun yarn Y is prevented from being trapped by the side wall of the nozzle block 22 and the side wall of the spindle support member 24.

(Operating state at time t3)

As described above, the spun yarn Y is inserted in the insertion hole 23*b* of the spindle 23, and the spindle support member 24 and the nozzle block 22 are coupled. At time t3 after the piecing preparations have finished, the back roller control signal switches from "0" to "1" (C, D) and the spinning control signal also switches from "0" to "1" (X, Z). In this way, the clutch 18 is connected by the switching of the back roller control signal from "0" to "1", the third rollers 12 and the back rollers 11 start rotating once again and the supply of sliver S is restarted.

Due to the rotation of the third rollers 12 and the back rollers 11, the tip Sa of the sliver S of which the fibers have been pulled by the stationary third rollers 12 and the still rotating middle rollers 13 and which is in the state wherein the sliver fiber density is a1 of the "rough state", passes unchanged through the middle rollers 13 and the front rollers 14 and is supplied to the piecing area 21*a* inside the air spinning nozzle 21 which has restarted. Due to the tip Sa of the sliver S and the sliver S continuous with the tip Sa in the normal state being successively supplied to the piecing area 21*a* inside the restarted air spinning nozzle 21, the sliver fiber density starts increasing from the sliver fiber density a1 (G) of the "rough state" to the "normal fiber density" a2 (H).

(Operating state at times t3–t4)

At times t3–t4, the back roller control signal is "1" (D, D0) and the spinning control signal is also "1" (Z, Z0). Further, the sliver fiber density gradually increases from the sliver fiber density a1 of the "rough state". Hereafter, the actions of the sliver S at times t3–t4 will be explained with reference to FIG. 6. At time t3, the sliver fiber density of the tip Sa positioned at the width condenser 48 is the sliver fiber density a1 of the "rough state", as described above, and the further towards the part Sn side of upstream from the tip Sa, the sliver fiber density increases. The sliver fiber density of part Sn is the "normal fiber density" a2.

From time t3, when the rotating of the back rollers 11 and the third rollers 12 resume, as the sliver S is transported in the direction of the middle rollers 13, which are rotating, the sliver fiber density at the position of the width condensor 48 gradually increases. As a result, at times t3–t4, the sliver fiber density changes from a1 of the "rough state" to a2 of the "normal fiber density" (G, H). The time (t3–t4) from time t3 at transmission of signals restarting the draft and spinning to when the sliver fiber density becomes a2 of the "normal fiber density", is longer compared to when the piecing method of the present invention is used (described later).

(Operating state at time t4)

At time t4, the back roller control signal is "1" (D, D0) and the spinning control signal is also "1" (Z, Z0). Furthermore, the increasing sliver fiber density has reached a2 of the "normal fiber density" (H). The sliver S at time t4 is in the state where the root (the right end of the length S1 of the tip Sa of the sliver of FIG. 6) of the tip Sa of the sliver S shown in FIG. 6 is positioned at the width condensor 48.

(Operating state at times t4–t5)

At times t4–t5, the back roller control signal is "1" (D, D0) and the spinning control signal is also "1" (Z, Z0). Furthermore, the sliver fiber density is uniform at a2 of the "normal fiber density" (H, H0). The actions of the sliver S at times t4–t5 will be described with reference to FIG. 6. The part Sn being at a2 of the "normal fiber density" is passed through the width condensor 48. Then the tip Sa of the sliver S is supplied to the piecing area 21*a* inside the air spinning nozzle 21 via the middle rollers 13 and the front rollers 14. Air is blown from the air blowing holes 30 of the air spinning nozzle 21 by the re-starting of the twisting device 2 and a rotating air current is generated in the vicinity of the tip 23*a* of the spindle 23. Accordingly, the fibers comprising the tip Sa of the sliver S supplied to the tip 23*a* of the spindle 23 join the yarn end Ya of the winding side spun yarn Y due to the aforementioned rotating air current and piecing is carried out.

As described above, on the conventional piecing method for the spinning machine, at time t3 at the re-starting of drafting and spinning, the sliver fiber density of the tip Sa of the sliver S of which the fibers have been pulled into a taper by the stationary third rollers 12 and the rotating middle rollers 13, is in the sliver fiber density a1 of the "rough state". As a tip Sa having a sliver fiber density a1 of "rough state" is supplied unchanged to the piecing area 21*a* of the air spinning nozzle 21 via the middle rollers 13 and the front rollers 14, the following problems arise.

FIGS. 12 and 13 are summary drawings showing the state before and after piecing by the conventional piecing method for the spinning machine of the tip Sa of the sliver S supplied to the piecing area 21*a* and the yarn end Ya of the winding side spun yarn Y. FIG. 12(*a*) shows before piecing and FIG. 12(*b*) shows after piecing.

FIG. 12 shows that when the tip Ya of the spun yarn Y overlaps the tip Sa of the sliver S. The length S1 of the tapered tip Sa of the sliver S shown in FIG. 6 is drafted by the middle rollers 13 and the front rollers 14 and becomes as long as the length S1a shown in FIG. 12(*a*) at the piecing area 21*a*. The length S1a is very long and as a result, the length Y6 of the fattened part of the piecing part Yc and the length Y7 of the thinned part become long as shown in FIG. 12(*b*), and, as a consequence, the total length YB of the piecing part Yc also becomes very long. Furthermore, as the fiber density of the tip Sa of the sliver S is at the sliver fiber density a1 of the "rough state", the strength of the thinned part Y7 of the piecing part Yc is greatly reduced. As a result, this causes an increase in yarn breakage and piecing errors.

Further, the case in which the tip Ya of the spun yarn Y overlaps the part Sn having a "normal fiber density" a2 of the sliver S so that the piecing part Ye does not include the thinned part Y7 is shown in FIG. 13. As described above, the length S1a of the tip Sa of the sliver S is very long and as a result, even if the length Y9 where the tip Ya of the spun yarn Y overlaps the part Sn having a "normal fiber density" a2 of the sliver S is made shorter, as shown in FIG. 13(*a*), the length Y10 of the piecing part Ye becomes longer, as shown in FIG. 13(*b*). Due to this, the quality of the spun yarn Y products is reduced by the thickened part of the piecing part Yc.

SUMMARY OF THE INVENTION

In order to solve the aforementioned problems present with the conventional piecing method for the spinning machine, it is an object of the present invention to propose a piecing method for a spinning machine that reduces the length of the tip of the sliver supplied to the piecing area during piecing and, moreover, is able to carry out reliable piecing by increasing the fiber density of the tip.

In order to achieve the above object, a first aspect of the present invention is that, after cutting the sliver between the continuedly rotating draft rollers 13 and 14 and the stopped draft 11 and 12 rollers after spinning operations have stopped, the stopped draft rollers 11 and 12 are restarted and rotate for a predetermined period of time to increase the fiber density at the tip of the sliver to be pieced. Thereafter, the draft rollers 11 and 12 are again stopped thereby cutting the sliver between the rotating draft rollers and the stopped draft rollers. Drafting and spinning operations are thereafter recommenced and sliver at a normal fiber density, or near normal fiber density is supplied to the air spinning nozzle by driving the aftermentioned stationary draft rollers.

A second aspect of the present invention increases the fiber density of the tip of the second cut sliver higher than the fiber density of the tip of the firstly cut sliver.

A third aspect of the present invention reduces the length of the tip of the second cut sliver to less than the length of the tip of the firstly cut sliver.

A fourth aspect of the present invention blows away the tip of the firstly cut sliver before the air spinning nozzle.

BRIEF DESCRIPTION OF THE DRAWINGS

FIG. 8 is an expanded side view of the sliver and the spun yarn before and after piecing by the piecing method for the spinning machine of the present invention.

FIG. 9 is an expanded side view of the sliver and the spun yarn before and after piecing by another embodiment of the piecing method for the spinning machine of the present invention.

FIG. 12 is an expanded side view of the sliver and the spun yarn before and after piecing by the conventional piecing method for the spinning machine.

DETAILED DESCRIPTION OF THE PREFERRED EMBODIMENT

Figure 1:
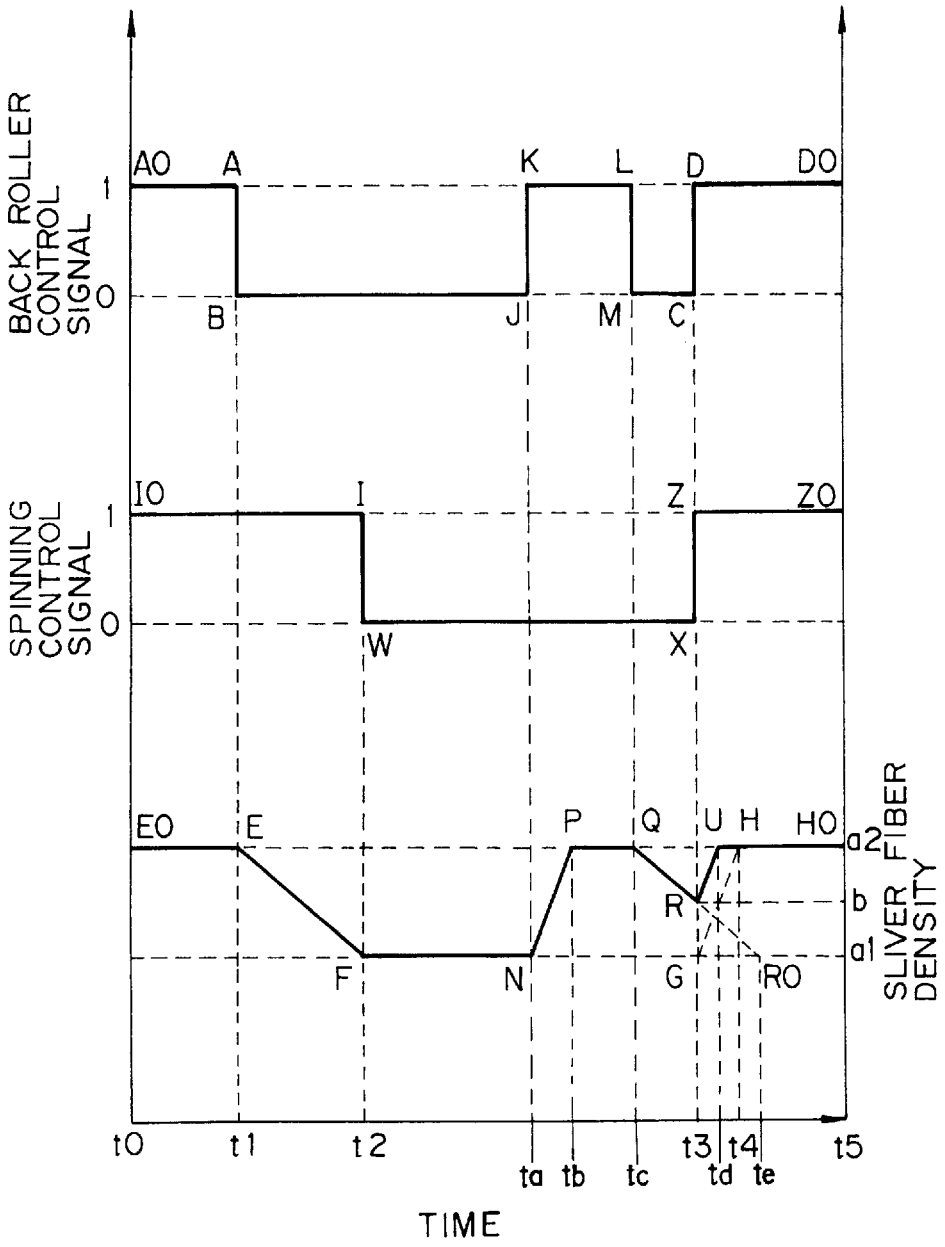
FIG. 1 is a time chart showing the inter-relationships between the back roller control signal, the spinning control signal and the sliver fiber density of the piecing method for the spinning machine of the present invention.

Hereafter, using FIG. 1 which is a time chart showing the interrelationships between the back roller control signal, the spinning control signal and the sliver fiber density of the piecing method for the spinning machine of the present invention, and other drawings, the piecing method for the spinning machine of the present invention will be described.

An example of the spinning machine to which the piecing method for the spinning machine of the present invention is applied has the structure the same as that in FIGS. 2–5 as previously described. Thus the description of those details has been omitted. It should be noted that, similar to FIG. 11, the horizontal axis of of FIG. 1 shows the time (timing) and the vertical axis shows respectively the back roller control signal, the spinning control signal and the sliver fiber density at that time. Further, "1" of the back roller control signal indicates an "ON" signal to the clutch 18, in short, "driving of the back rollers and the third rollers". "0" indicates an "OFF" signal to the clutch 18, in short, "stopping of the back rollers and the third rollers". Furthermore, "1" of the spinning control signal indicates the generation of a rotating air current inside the air spinning nozzle 21, in short, "spinning operation" and "0" of the spinning control signal indicates the stoppage of the rotating air current inside the air spinning nozzle 21, in short, "spinning stoppage".

Next, an embodiment of the piecing method for the spinning machine of the present invention will be described concentrating on FIG. 1.

(Operating state at times t0–t1)

Figure 11:
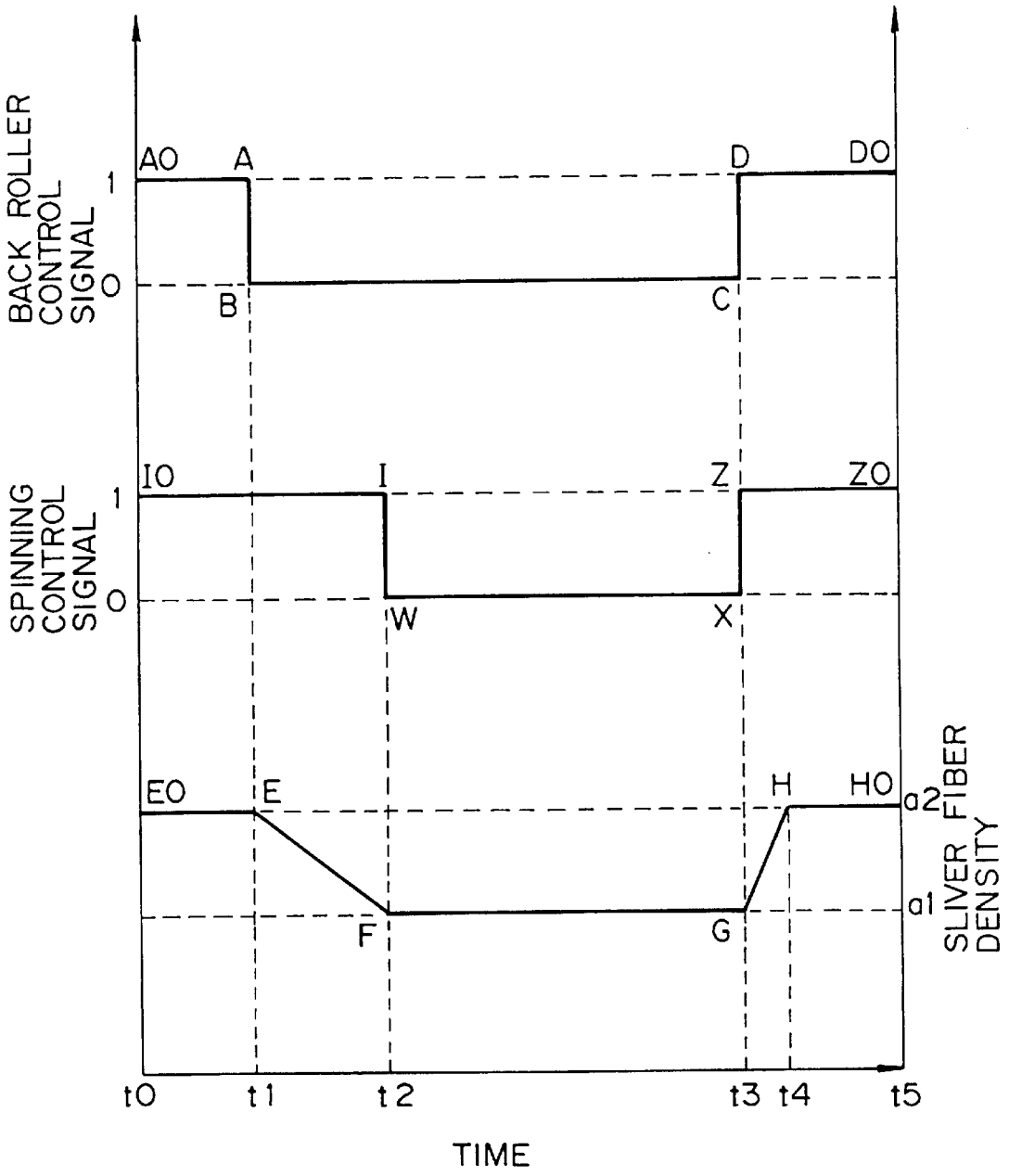
FIG. 11 PRIOR ART
FIG. 11 is a time chart showing the inter-relationships between the back roller control signal, the spinning control signal and the sliver fiber density of the conventional piecing method for the spinning machine.

Similar to the conventional piecing method for the spinning machine described using mainly FIG. 11, on the piecing method for the spinning machine of the present invention, at times t0–t1, the back roller control signal is "1" (A0, A) and the spinning control signal is also "1" (I0, I). Further, the sliver fiber density is at a2 of the "normal fiber density" and is constant (E0, E). Times t0–t1 indicates the operating state during normal spinning in which the draft device 1 and the twisting device 2, and the like, are operating and each spinning unit of the spinning machine is spinning the yarn Y.

(Operating state at time t1)

The operating state at time t1 of the piecing method for the spinning machine of the present invention is also the same as the operating state at time t1 of the conventional piecing method for the spinning machine. In short, the back roller control signal switches from "1" to "0" (A, B) but the spinning control signal is the same as before, being at "1" (I0, I). Further, at time t1, the sliver fiber density is at a2 of the "normal fiber density" (E) but afterwards, starts decreasing. When a yarn breakage occurs, a detection signal is sent from a detection sensor (not shown in the drawing) and according to this signal, a stop signal is sent to the clutch 18 connected to the back rollers 11. Thus, the rotation of the unit shaft 19 stops and due to this, the back rollers 11 and the third rollers 12 are forcibly stopped and the supply of the sliver S is stopped. The twisting device 2 continues operating as before.

(Operating state at times t1–t2)

The operating state at times t1–t2 of the piecing method for the spinning machine of the present invention is also the same as the operating state at times t1–t2 of the conventional piecing method for the spinning machine. In short, at times t1–t2, the back roller control signal is "0" (B, J) and the spinning control signal is unchanged at "1" (I0, I). However, the fiber density of the sliver S gradually decreases from the "normal fiber density" a2 of the normal spinning state at times t0–t1 (E, F). Due to the stationary back rollers 11 and third rollers 12 and the rotating middle rollers 13, the sliver S between the third rollers 12 and the middle rollers 13 is gradually pulled by the rotating middle rollers 13 while a gap is generated between the fibers from time t1. Then, the fiber density of the sliver S which has started to be pulled, gradually decreases from a2 of the "normal fiber density" of the aforementioned normal spinning state, and the sliver S between the stationary third rollers 12 and the rotating middle rollers 13 becomes gradually thinner. The twisting device 2 continues operating as before.

(Operating state at time t2)

The operating state at time t2 of the piecing method for the spinning machine of the present invention is also the same as the operating state at time t2 of the conventional piecing method for the spinning machine. In short, at time t2, the back roller control signal is "0" as before (B, J) but the spinning control signal switches from "1" to "0" (I, W). Further, the reduced sliver fiber density is at a1 of the "rough state" (F). The sliver S, of which the fibers are continuously being pulled by the stationary back rollers 11 and third rollers 12 and the still driving middle rollers 13, is pulled apart between the third rollers 12 and the middle rollers 13 into a pointed shape. Furthermore, at time t2, the operation of the twisting device 2 stops and spinning stops. In comparison with the "normal fiber density" a2 of the sliver S, the tip Sa of the sliver S pulled apart becomes a1 being the rough fiber density in which the sliver fibers are greatly insufficient. It should be noted that the Sm side of the pulled apart sliver S passes via the front rollers 14 and the twisting device 2 in an operating state of prior to time t2 and is sucked and ejected by a suction means arranged in the vicinity of the yarn defect detector.

(Operating state at times t2–ta)

The operating state at times t2–ta of the piecing method for the spinning machine of the present invention is also the same as the operating state at times t2–t3 of the conventional piecing method for the spinning machine. In short, at times t2–ta, the back roller control signal is at "0" as before (B, J) and the spinning control signal is also at "0" (W, X). Furthermore, the sliver fiber density is at a1 of the "roughed state" in which fibers are greatly insufficient (F, N). The back rollers 11 and the third rollers 12 are stationary, the supply of the sliver S has stopped and, accordingly, the pulled apart sliver S also stops. The twisting device 2 is stationary and spinning has stopped.

Figure 4:
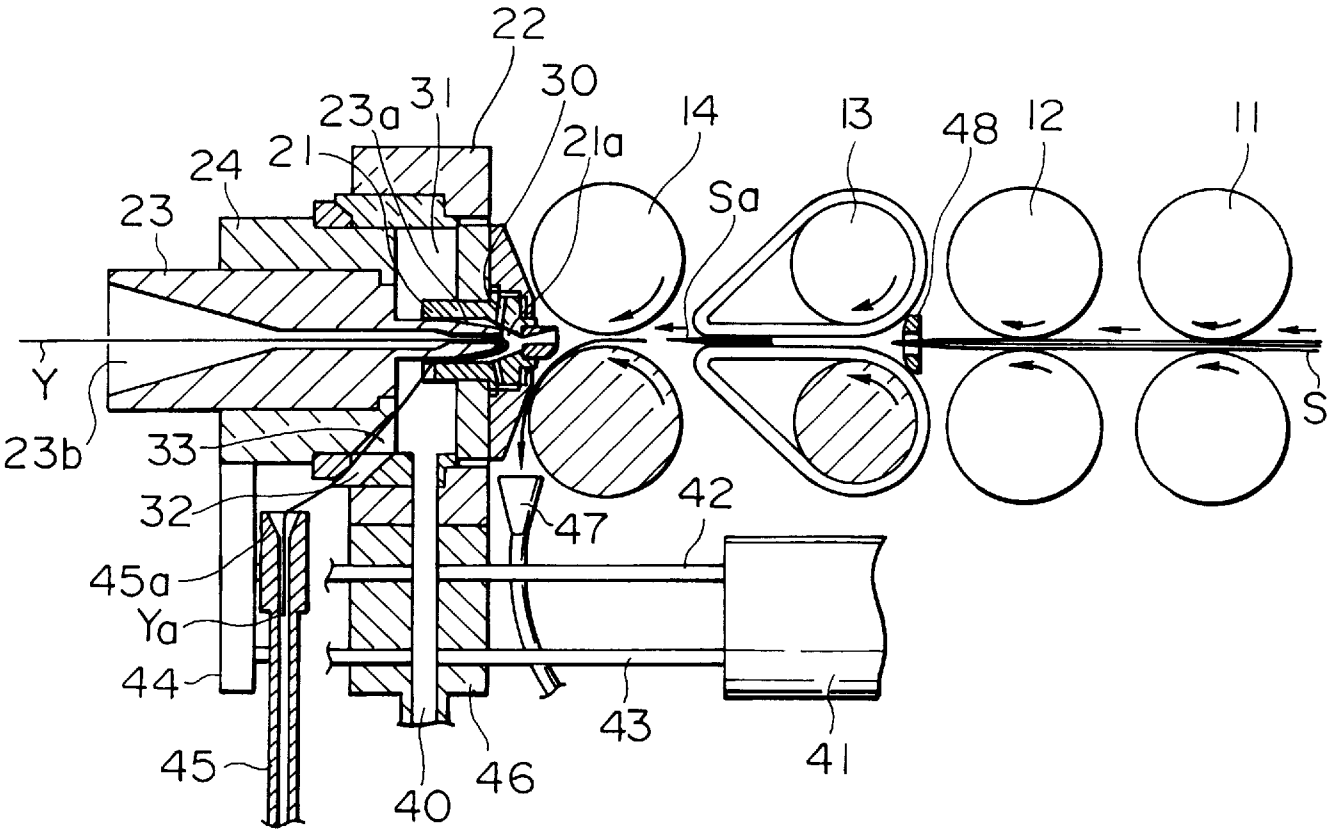
FIG. 4 is side view similar to FIG. 2 including a partial side section of an example of the spinning machine applied to the present invention.

Preparation operations for piecing are carried out on the piecing method for the spinning machine of the present invention at times t2–ta similar to the operating state at times t2–t3 of the conventional piecing method for the spinning machine. In short, as shown from the state in FIG. 2 to FIG. 3, the spindle support member 24 and the spindle 23 separate from the nozzle block 22 and the air spinning nozzle 21. And then, the yarn end Ya of the winding side spun yarn Y is reverse inserted into the insertion hole 23*b* of the spindle 23, and the yarn end Ya of the spun yarn Y which hangs down by a predetermined length from the tip 23*a* of the spindle 23 is sucked into the suction pipe 45 and held at a predetermined tension. Next, as shown in FIG. 4, the nozzle block 22 and the spindle support member 24 are once again recoupled and the spindle returns to its original position. In this way, the preparation operations for piecing are completed.

At time t3 of the conventional piecing method for the spinning machine as described above, drafting and spinning restart but preceeding that, according to the present invention the following operations are carried out on the piecing method for the spinning machine which differ from the conventional piecing method for the spinning machine.

(Operating state at time ta)

At time ta, the back roller control signal switches from "0" to "1" (J, K). However, the spinning control signal is unchanged at "0" (W, X). Furthermore, the sliver fiber density is at a1 of the "rough state" (N) but afterwards increases.

The operations of the spinning machine at time ta will be described with reference to FIG. 4. The rotation of the stationary back rollers 11 and the third rollers 12 restarts and the tip Sa of the sliver S gripped in the back rollers 11 and the third rollers 12 is moved in the direction of the middle rollers 13 which are rotating. In association with the switching of the back roller control signal from "0" to "1", the clutch 18 shown in FIG. 2 is once again reactivated and the rotation of the stationary back rollers 11 and the third rollers 12 restarts. As mentioned above, the tip Sa of the sliver S is supplied to the middle rollers 13 which are rotating.

(Operating state at times ta–tc)

At times ta–tc, the back roller control signal continues to be "1" (K, L) and the spinning control signal is at "0" as before (W, X). However, the sliver fiber density at times ta–tc changes from times ta–tb in association with the movement of the tip Sa of the sliver S towards the middle roller 13 due to the restarting of the stationary back rollers 11 and the third rollers 12. In short, the sliver fiber density being a1 of the "rough state" at time ta, gradually increases during times ta–tb (N, P) and at time tb, is a2 of the "normal fiber density". Afterwards, the sliver fiber density continues to be at a2 of the "normal fiber density" from times tb–tc (P, Q).

The actions of the sliver S at times ta–tc will be described with reference to FIGS. 6 and 7.

Figure 6:
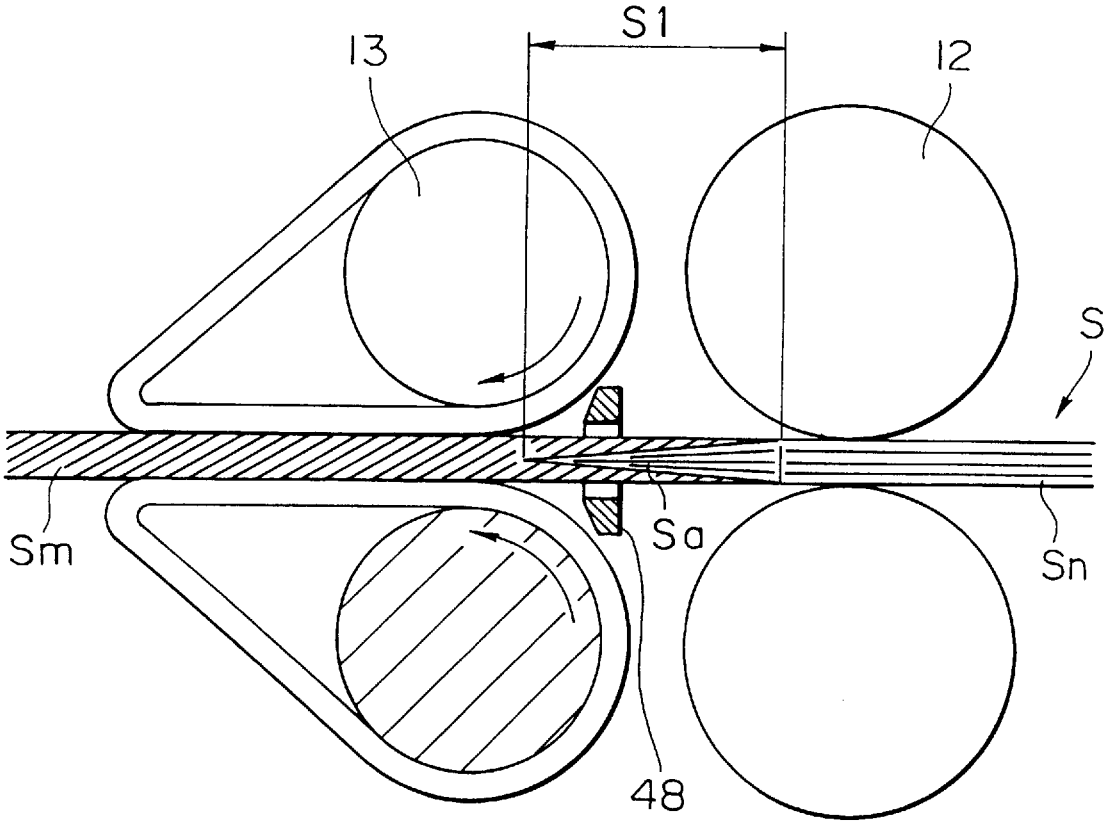
FIG. 6 PRIOR ART
FIG. 6 is an expanded side view of the appearance of the tip of the sliver pulled apart between the third rollers and the middle rollers by a conventional piecing method for a spinning machine.

As described above, the fibers of the tip Sa of the sliver S at time ta are pulled due to the stationary third rollers 12 and the rotating middle rollers 13, as shown in FIG. 6, and form a long tapered shape. Then, at time ta, the sliver fiber density of the tip Sa at the width condensor 48 is a1 of the "rough state" as described above. The fiber density of the tapered tip Sa increases the further upstream (sliver guide side 10).

From time ta, when the back rollers 11 and the third rollers 12 restart, the sliver fiber density at the width condensor 48 gradually increases as the sliver S is transported in the direction of the rotating middle rollers 13. At times ta–tb, the sliver fiber density gradually increases from a1n of the "rough state" to a2 of the "normal fiber density" (N, P) as the root of the tip Sa of the sliver S (the right end of the length S1 of the tip Sa shown in FIG. 6) reaches the width condensor 48.

At times tb–tc, the part Sn having the "normal fiber density" a2 of the sliver S remains constant at the "normal fiber density" a2 as it is sequentially supplied to the middle rollers 13 via the width condensor 48. Then, at time tc, the tip Sa of the sliver S is positioned approximately ahead of the middle rollers 13. It should be noted that times tb–tc is the time for the part Sn having a "normal fiber density" a2 of the sliver S to be supplied reliably to the middle rollers 13.

(Operating state at time tc)

At time tc, the back roller control signal switches from "1" to "0" (L, M). Conversely, the spinning control signal is unchanged at "0" (W, X). Furthermore, the sliver fiber density is at a2 of the "normal fiber density" (Q) and afterwards starts decreasing.

The operations of the spinning machine at time tc will be described with reference to FIG. 2. Similar to time t1, the clutch 18 is cut, the brake connected with this operates and the rotation of the unit shaft 19 stops. Due t6 this, the back rollers 11 and the third rollers 12 are forcibly stopped and the supply of the sliver S is stopped. The end of the tip Sa of the sliver S then reaches approximately ahead of the middle rollers 13 as shown in FIG. 7. Similar to time t1, the tip Sa of the sliver S which has reached the position shown in FIG. 7 at time tc, due to the stationary back rollers 11 and third rollers 12 and the rotating middle rollers 13, is gradually pulled by the rotating middle rollers 13 while a gap between the fibers is being generated.

(Operating state at times tc–t3)

At times tc–t3, the back roller control signal is "0" (M, C) and the spinning control signal is unchanged at "0" (W, X). The sliver fiber density decreases gradually from a2 of the "normal fiber density" similar to times t1–t2 (Q, R). The rate of reduction of the sliver fiber density at times tc–t3 (Q, R) is the same as the rate of reduction of the sliver fiber density at times t1–t2 (E, F).

The operation of the spinning machine at times tc–t3 will be described with reference to FIG. 4. The sliver S between the third rollers 12 and the middle rollers 13 is gradually pulled by the rotating middle rollers 13 while a gap between the fibers is being generated due to the stationary back rollers 11 and third rollers 12 and the rotating middle rollers 13. The tip Sa of the sliver S gripped by the rotating middle rollers 13 and gradually pulled is pulled via the front rollers 14 into the fly waste suction pipe 47 that removes fly waste as the twisting device 2 is not operating.

The actions of the sliver S at times tc–t3 will be described with reference to FIG. 7. The fiber that comprises the tip Sa of the sliver S positioned as shown in FIG. 7 by the rotation of the aforementioned back rollers 11 and the third rollers 12 (times ta–tc) and the stoppage (time tc) is gradually pulled by the rotating middle rollers 13.

(Operating state at time t3)

At time t3, the back roller control signal switches from "0" to "1" (C, D) and the spinning control signal also switches from "0" to "1" (X, Z). The reduced sliver fiber density is at b (R) but afterwards starts increasing. Due to the switch of the back roller control signal from "0" to "1", the clutch 18 is coupled, the back rollers 11 and the third rollers 12 start rotating once again and the supply of sliver S is resumed.

Figure 5:
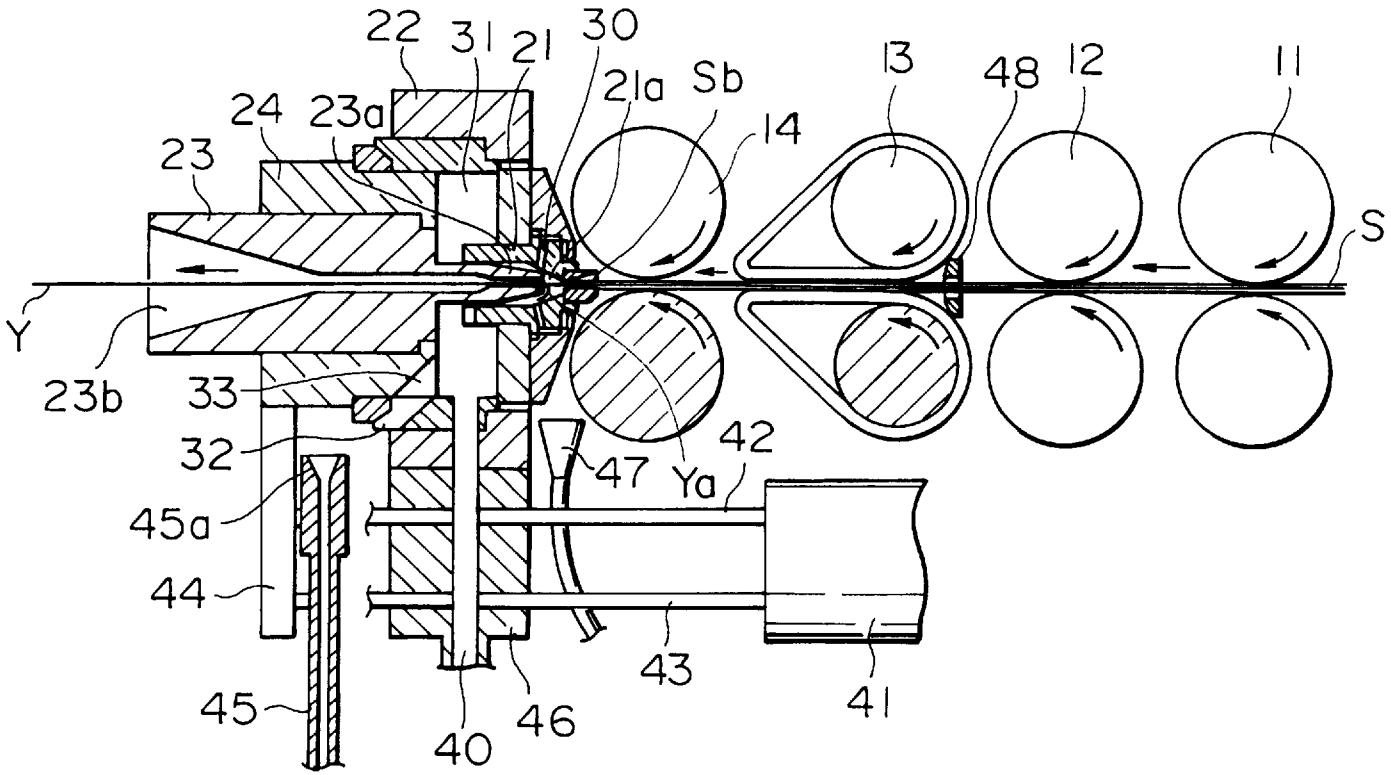
FIG. 5 is side view similar to FIG. 2 including a partial side section of an example of the spinning machine applied to the present invention.

The actions of the sliver S at time t3 will be described with reference to FIG. 7. At the aforementioned times tc–t3, the fiber is continuously pulled by the stationary back rollers 11 and third rollers 12 and the rotating middle rollers 13, and the fiber density of the tip Sb of the cut sliver S positioned at the width condensor 48 becomes the sliver fiber density b intermediate a1 of the "rough state" and a2 of the "normal fiber density", in short, a1<b<a2. The number of fibers of the tip Sb are few compared to the part Sn having a "normal fiber density" a2 but has enough fibers without becoming the sliver fiber density a1 of the "rough state" as with the aforementioned tip Sa. Also, the length S2 of the tapered tip Sb is much shorter than the length S1 of the aforementioned tip Sa. As shown in FIG. 5, the tip Sb of short length S2 and having sufficient fibers of sliver fiber density b is supplied to the piecing area 21*a* inside the air spinning nozzle 21 via the middle rollers 13 and the front rollers 14. In this way, the tip Sa having sliver fiber density a1 "rough state" as with conventional sliver fiber density is not supplied to the piecing area 21*a*.

Figure 7:
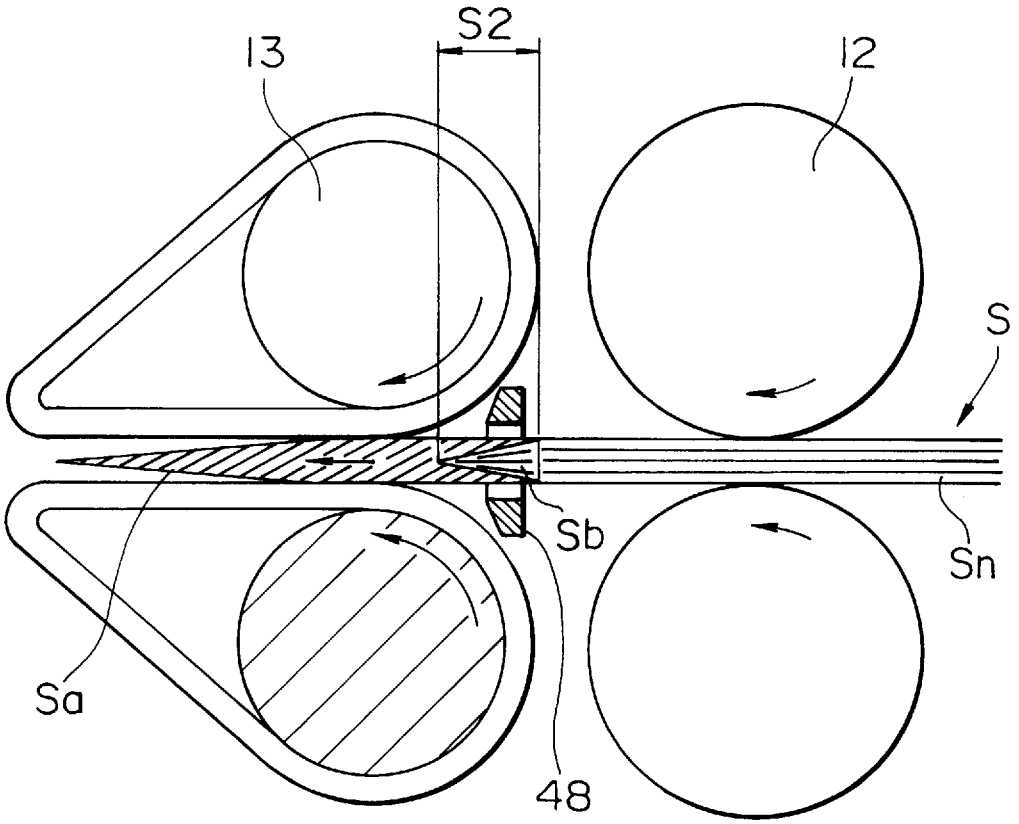
FIG. 7 is an expanded side view of the appearance of the tip of the sliver pulled apart between the third rollers and the middle rollers by the piecing method for the spinning machine of the present invention.

Thus, supposing after time t3, the stoppage of the back rollers 11 and third roller 12 continues, the fibers of the tip Sb shown in FIG. 7 would be continuously pulled by the rotating middle rollers 13 and that tip would have a sliver fiber density a1 of the "rough state" and become a long thin tip Sa as shown in FIG. 6. Thus, supposing even after time t3, the back roller control signal is "0", the sliver fiber density at time t3 continues decreasing after times tc–t3 and eventually at time te would become sliver fiber density a1 of the "rough state" (R, R0). The reduction in the sliver fiber density at times tc–te (Q, R0) is the same as the aforementioned reduction in the sliver fiber density at times t1–t2 (E, F), in short, (t2–t1)=(te–tc).

As previously mentioned, preceeding the restart signals of the draft and spinning (C, D), (X, Z) at time t3 on the present invention, at times ta–t3, the back roller control signals comprising the drive start signal (J, K), the drive signal (K, L), the stoppage start signal (L, M) and stop signal (M, C) are sent to the back rollers 11.

(Operating state at times t3–td)

At times t3–td, the back roller control signal is "1" (D, D0) and the spinning control signal is also "1" (Z, Z0). The sliver fiber density gradually increases from sliver fiber density b.

The actions of the sliver S at times t3–td will be described with reference to FIG. 7. The tip Sb of the sliver S at time t3 is positioned at the width condensor 48, as shown in FIG. 7. The sliver fiber density of the tip Sb positioned at the width condensor 48 at time t3 is the fiber density b between the sliver fiber density a1 of the "rough state" and a2 of the "normal fiber density", and the further towards the upstream Sn part, the higher the sliver fiber density. The sliver fiber density at part Sn is a2 of the "normal fiber density", as described above. When the rotation of the back rollers 11 and the third rollers 12 restarts at time t3, the sliver fiber density at the width condensor 48 gradually increases as the tip Sb of the sliver S is transported in the direction of the rotating middle rollers 13. Due to this, the sliver fiber density at times t3–td gradually increases from the sliver fiber density b to a2 of the "normal fiber density" (R, U).

In the piecing method for the present invention, the time period from time t3 when the draft and spinning restart signals are sent to when the sliver fiber density becomes a2 of the "normal fiber density" is the time period t3 to td, as compared with the aforementioned conventional piecing method wherein the time period is time period t3–t4 from time t3 when the draft and spinning restart signals are sent to when the sliver fiber density becomes a2 of the "normal fiber density". By comparison, therefore, the time for the piecing method of the present invention from time t3, when the draft and spinning restart signals are sent, to when the sliver fiber density becomes a2 of the "normal fiber density" is shorter than for the aforementioned conventional method.

When the phase (R, U) of the piecing method for the present invention from when the sliver fiber density becomes a2 of the "normal fiber density" from the sliver fiber density b and the phase (G, H) of the conventional piecing method from when the sliver fiber density becomes a2 of the "normal fiber density" from the sliver fiber density a1 of the "rough state", are compared, the time from time t3 when the draft and spinning restart signals are sent to when the sliver fiber density becomes a2 of the "normal fiber density" in the case of phase (R, U) of the piecing method for the present invention is the time period t3–td and for the phase (G, H) of the conventional piecing method is the time period t3–t4 and accordingly on the piecing method for the present invention the concerned time period is reduced by the amount represented by time period t4–td. This is due to the length S2 of the tip Sb of the sliver S of the piecing method for the present invention being short relative to the length S1 of the long thin tip Sa of the sliver S of the conventional piecing method.

(Operating state at time td)

At time td, the back roller control signal is "1" (D, D0) and the spinning control signal is also "1" (Z, Z0). The increased sliver fiber density has reached a2 of the "normal fiber density" (U).

(Operating state at times td–t5)

At times td–t5, the back roller control signal is "1" (D, D0) and the spinning control signal is also "1" (Z, Z0). The sliver fiber density is constant at a2 of the "normal fiber density" (U, H0).

The actions of the sliver S at times td–t5 will be described with reference to FIG. 7. The part Sn having a "normal fiber density" a2 passes through the width condensor 48. Then, as shown in FIG. 5, the tip Sb of the sliver S is supplied to the piecing area 21*a* of the air spinning nozzle 21 via the middle rollers 13 and the front rollers 14. Due to the restarting of the twisting device 2, air is blown from the air blowing holes 30 of the air spinning nozzle 21 and a rotating air current is generated in the direction of the tip 23*a* of the spindle 23. Afterwards, the fibers comprising the tip Sb of the sliver S supplied to the piecing area 21*a* are attached to the yarn end Ya of the winding side spun yarn Y by the aforementioned rotating air current and piecing is carried out.

FIGS. 8 and 9 are summarised drawings showing the state before and after piecing of the tip Sb of the sliver S supplied to the piecing area 21*a* in the air spinning nozzle 21 with the yarn end Ya of the spun yarn Y by the piecing method of the present invention. FIG. 8(*a*) is before piecing and FIG. 8(*b*) is after piecing.

FIG. 8 shows the case of the tip Ya of the spun yarn Y overlapping the tip Sb of the sliver S. The length S2 of the tapered tip Sb shown in FIG. 7 is drafted by the middle rollers 13 and the front rollers 14 and becomes length S2a in the piecing area 21*a* as shown in FIG. 8(*a*). This length S2a of the tip Sb of the sliver S is much shorter than the length S1a of the tip Sa of the sliver S on the conventional piecing method as previously described. Due to this, as shown in FIG. 8(*b*), both the length Y1 of the fat part of the piecing part Ye and the thin part Y2 are short. Accordingly, the entire length Y3 of the piecing part Ye is shortened. In comparison with the entire length Y8 of the length Y6 of the fat part and the thin part Y7 of the piecing part Yc of the conventional piecing method shown in FIG. 12, the lengths Y1, Y2 and Y3 of the piecing method of the present invention are all shorter.

Furthermore, the tip Sb of the sliver S having the fiber density b has sufficient fibers and as the sliver fiber density is high, even the thin part Y2 is of sufficient strength. In the conventional piecing method, as shown in FIG. 12, the fiber density of the tip Sa of the sliver S is a1 of the "rough state" thus the thin part Y7 of the piecing part Yc is weak and, after piecing, repeated breakage occurs. This problem does not occur on the present invention.

Figure 13A:
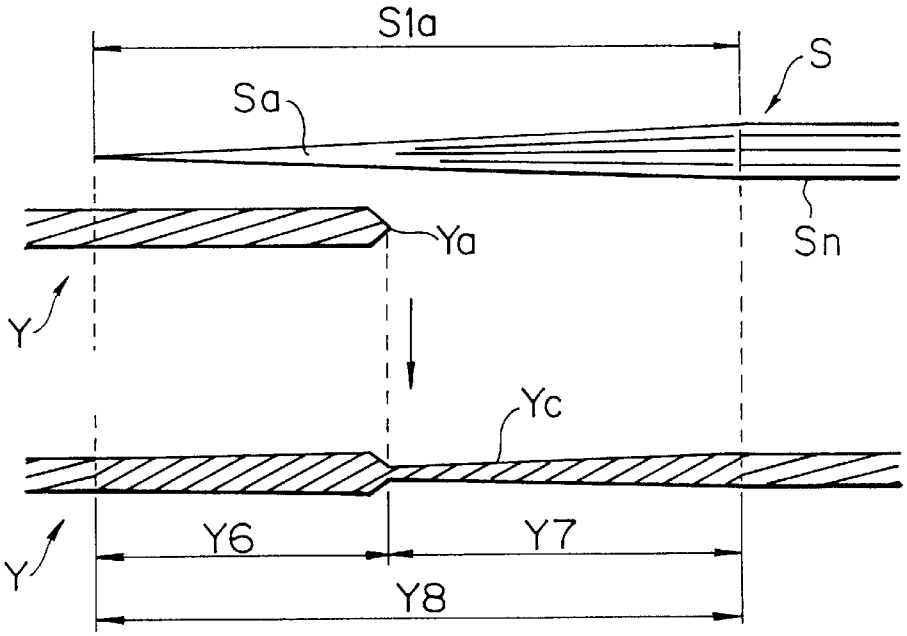
FIG. 13(a) PRIOR ART
FIG. 13 is an expanded side view of the sliver and the spun yarn before and after piecing by the conventional piecing method for the spinning machine.
Figure 13B:
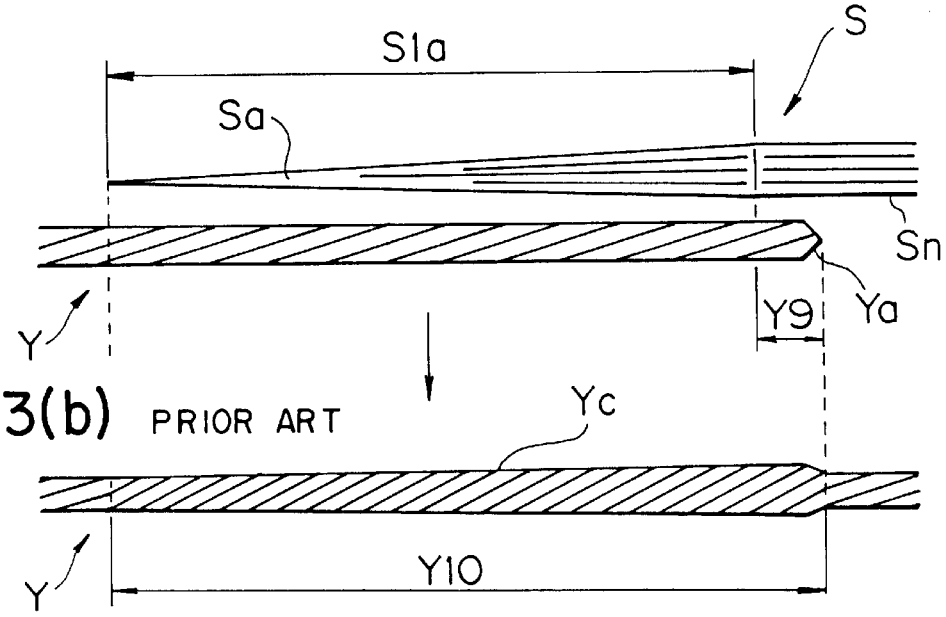
FIG.13(b) PRIOR ART

FIG. 9 shows the case of the tip Ya of the spun yarn Y overlapping the tip Sn of the sliver S having a2 of the "normal fiber density". In this way, the formation of the thin part Y2 can be prevented by the overlapping the tip Sn of the sliver S having a2 of the "normal fiber density" with the tip Ya of the spun yarn Y. As described above, as the length S2a of the tip Sb of the sliver S is short, if the length Y4 of the tip Ya of the overlapped spun yarn Y is set shorter, as shown in FIG. 9(*a*), the length Y5 of the piecing part Ye also becomes relatively shorter, as shown in FIG. 9(*b*). Accordingly, there is no reduction in quality of the spun yarn Y as a result of the piecing part Yc pieced by the piecing method of the present invention being long as shown in FIG. 13. Also, concerning the piecing part Ye from the conventional piecing method, as shown in FIG. 13, even if the length Y9 of the tip Ya of the overlapped spun yarn Y is as set short, the length Y10 of the piecing part Ye is long as the length S1a of the tip Sa of the sliver S is long.

Figure 2:
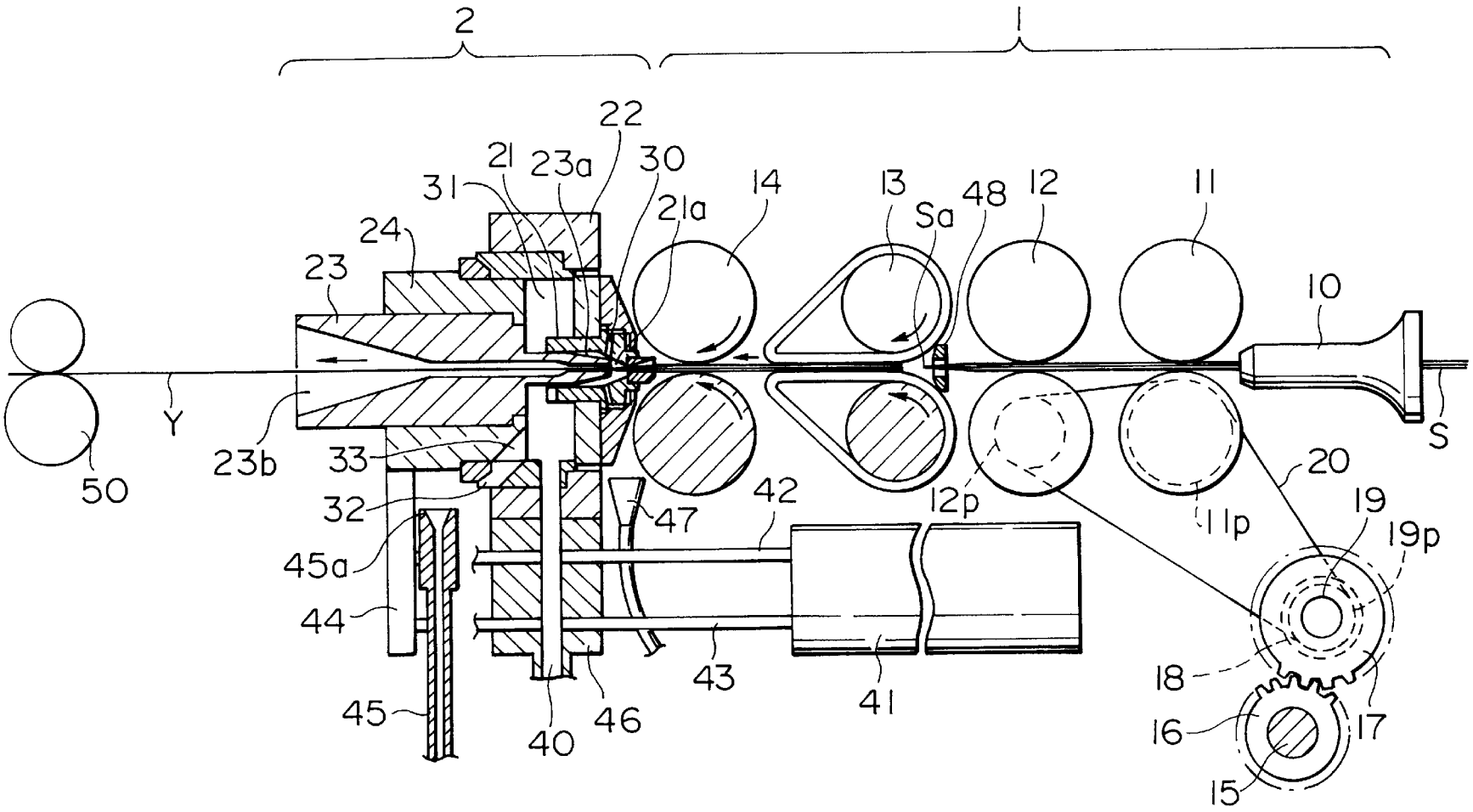
FIG. 2 is side view including a partial side section of an example of the spinning machine applied to the present invention.
Figure 3:
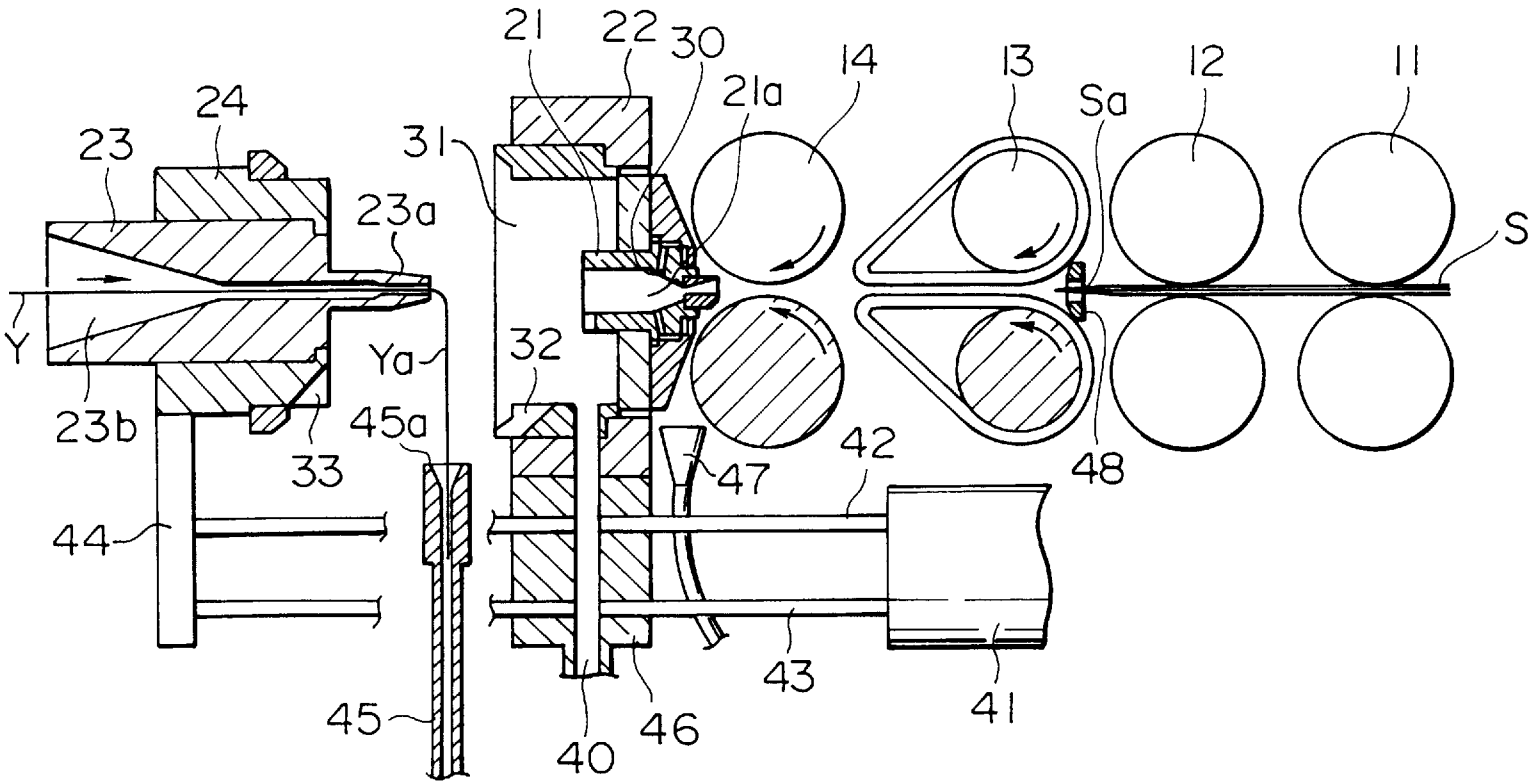
FIG. 3 is side view similar to FIG. 2 including a partial side section of an example of the spinning machine applied to the present invention.

It should be noted that it is possible to obtain a desired length of the overlapped part of the tip Ya of the spun yarn Y and the sliver S shown in FIGS. 8 and 9 by adjustment of the drive timing of the nip roller 50 shown in FIG. 2 and the timing of the control signal of the back rollers 11, and the like.

As previously described, on the piecing method for the spinning machine of the present invention, the piecing part Yc can be shortened and, even if thin part Y2 is formed on the piecing part Ye, the strength of that part Y2 is sufficient and there is no reduction in quality of the product.

The four-line type draft device 1 has been described on the aforementioned embodiment but a three-line type or a five-line type or higher draft device is also possible for the present invention. Further, the pulling apart of the sliver S between the middle rollers 13 and the third rollers 12, in short, the stoppage of the third rollers 12 and draft rollers further upstream (back rollers 11) on the aforementioned embodiment has been described but an embodiment whereby a draft roller and those further upstream is optionally stopped including stoppage of the middle rollers 13 also, is possible. However, by making the third rollers 12 and the middle rollers 13, which are close to the piecing area 21*a* and the draft rollers upstream from there the stoppage rollers and, moreover, including the middle rollers 13, the pulling apart and supply of the sliver S between the draft rollers close to this is convenient from the point of timing and stability of the fiber amount.

Further, a case where piecing is performed by the twisting device 2 that positions the spindle 23 inside the air spinning nozzle 21 is shown on the aforementioned embodiment. However, the present invention is not limited to that and other devices that carry out piecing by the restarting of spinning may also be embodied.

Figure 10:
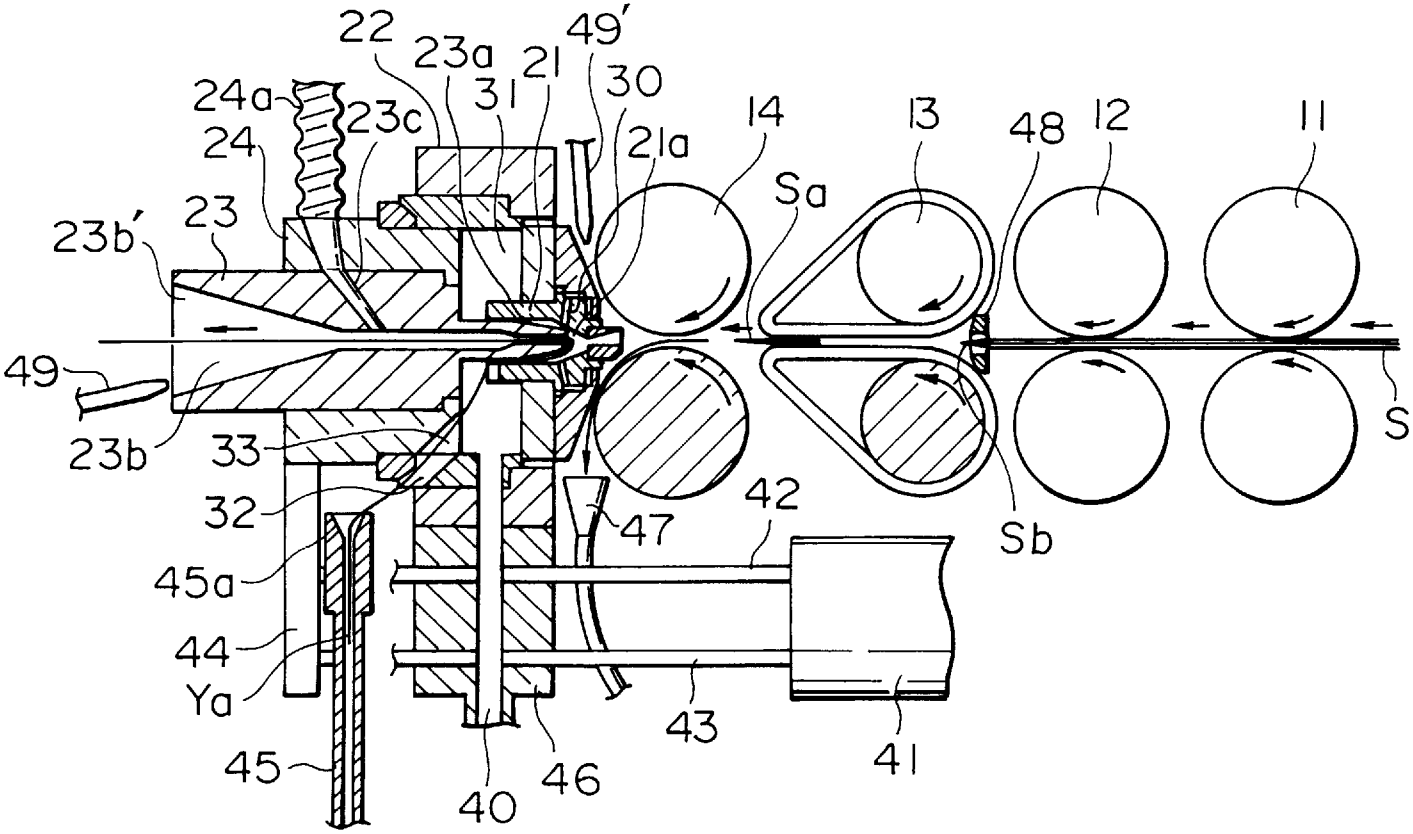
FIG. 10 is side view similar to FIG. 4 including a partial side section of an example of the spinning machine applied to another embodiment of the present invention.

Next, another embodiment of the piecing method for the spinning machine of the present invention will be described using FIG. 10 being similar to FIG. 4.

In this embodiment, an air blowing hole 23*c* for generating an air stream in the direction of the tip 23*a* of the spindle 23 is present inside the insertion hole 23*b*. In the present embodiment, the air blowing hole 23*c* is bored through the spindle 23 and the spindle support member 24. The air blowing hole 23*c* is connected to a compressed air supply source (not shown in the drawing) via a pipe 24*a* connected to the spindle support member 24.

In the present invention as described above, after a cessation of spinning operations for yarn breakage or doffing, the back rollers 11 and the third rollers 12 are forcibly stopped. The sliver S is cut between the stationary third rollers 12 and the rotating middle rollers 13 and the tip Sa of the sliver S is formed into a tapered shape as shown in FIGS. 6, 12(*a*) and 13(*a*).

Afterwards, at times t2–ta, the spindle support member 24 and the spindle 23 are separated from the nozzle block 22 and the air spinning nozzle 21. Then, after the yarn end Ya of the winding side spun yarn Y has been inserted into the insertion hole 23*b* of the spindle 23, the nozzle block 22 and the spindle support member 24 are recoupled and the preparation operations of piecing are completed.

At times ta–t3 after the completion of the aforementioned piecing preparation operations, the back rollers 11 and the third rollers 12 are rotated for a short period of time while the spinning control signal is "0", in short, while the air spinning nozzle 21 is not operating, and the sliver S is moved towards the middle rollers 13. Afterwards, the back rollers 11 and the third rollers 12 are stopped once again and due to the recutting of the sliver S between the stationary third rollers 12 and the rotating middle rollers 13, the tip Sb of the higher fiber density and the shorter sliver S is formed.

As described above, the tip Sa having a1 of the "rough state sliver fiber density" sent by the back rollers 11 and the third rollers 12 being rotated for a short period of time, is sucked into the fly waste suction pipe 47 used for removing fly waste, via the front rollers 14 as the twisting device 2 is not operating. However, when this suction is insufficient, the tip of the sliver S enters the air spinning nozzle 21, blocks the air spinning nozzle 21 and the spindle 23 and may cause piecing failure.

In the present embodiment, from around the restarting of drafting and spinning, until immediately before the piecing operation of the tip Ya of the spun yarn Y at the piecing area 21*a* of the air spinning nozzle 21 with the fiber comprising the tip Sb of the sliver S, compressed air is sent to the air blowing hole 23*c* via the pipe 24*a* connected to the spindle support member 24 and air is blown via the tip 23*a* of the spindle 23 towards the front rollers 14 from the air spinning nozzle 21. Thus, due to the blowing of air towards the front rollers 14 from the air spinning nozzle 21, the tip Sa of the sliver S sent preceeding the restarting of spinning is blown away from infront of the air spinning nozzle 21 and accordingly does not block the air spinning nozzle 21 or spindle 23.

After the completion of the removal operations of the tip Sa of the sliver S as described above, the supply of compressed air to the air blowing hole 23*c* is stopped. It is preferable to stop the supply of compressed air to the air blowing hole 23*c* before the tip Sb of the sliver S which is continuous with the tip Sa, pieced onto the tip Ya of the spun yarn Y, has a higher fiber density and moreover a short tip Sb, is guided into the air spinning nozzle.

Instead of the arrangement of the air blowing hole 23*c* in the spindle 23 and the spindle support member 24, an arrangement is possible as a means for blowing air from the air spinning nozzle 21 towards the front rollers 14 in order to remove the tip Sa of the sliver S, whereby a movable air blowing nozzle 49 is positioned at the exit 23*b*' (spun yarn Y exhaust) of the insertion hole 23*b* of the spindle 23, air is blown from that air blowing nozzle 49 and air is made to blow from the air spinning nozzle 21.

Further, an arrangement is possible whereby an air blowing nozzle 49' is positioned in the space between the front rollers 14 and the nozzle block 22, air is blown from that air blowing nozzle 49' in the direction of the guide entrance 21*b* of the sliver S of the air spinning nozzle 21 and the tip Sa of the sliver S is blown away from in front of the air spinning nozzle 21. In this situation, it is preferable for the aforementioned air blowing nozzle 49' to be positioned opposite the fly waste suction pipe 47 sandwiching the guide entrance 21*b* of the sliver S of the air spinning nozzle 21. Due to this arrangement, the tip Sa of the blown away sliver S is sucked directly into the fly waste suction pipe 47 and does not float freely in the air for a long period of time.

Due to the arrangement as described above, the present invention demonstrates the following advantages.

Not only can the sliver fiber density of the sliver end supplied to the piecing area during piecing be increased, but that length of the tip of the sliver can also be shortened. Accordingly, the strength of the piecing part is increased and the length of the piecing part can be shortened.

Even if a thin part of the piecing part is produced, it is short and moreover, is of sufficient strength and there is no occurrence of problems such as re-breakage of the yarn or piecing errors. Furthermore, a thick part of the piecing part is also short and the quality of the spun yarn increases.

As the tip of the firstly cut sliver is blown away from infront of the air spinning nozzle, the tip of the firstly cut sliver can not enter the air spinning nozzle and blockage of the air spinning nozzle and spindle is prevented.

What is claimed is:

1. For use in a spinning machine having a plurality of draft rollers forming a draft part for supplying sliver, a spinning part for twisting the sliver into yarn, and a winding part for accumulating the spun yarn, a method for piecing newly supplied sliver to an end of spun yarn following breakage of the sliver and stoppage of the spinning operations, comprising the steps of:

removing the portion of the broken sliver having an end of rough fiber density from between rotating draft rollers and stopped draft rollers;

rotating the stopped draft rollers for a predetermined period of time to produce sliver of normal fiber density;

stopping at least one draft roller while rotating at least one other draft roller to break the sliver of normal fiber density to produce a sliver portion of near normal fiber density; and thereafter, resuming operation of the entire draft part and the spinning part and conducting the piecing operation between the spun yarn end and the sliver portion of near normal fiber density.

2. The piecing method according to claim 1 in which the piecing operation includes the steps of:

reversely guiding said spun yarn end into the spinning part;

supplying said sliver portion to said spinning part to join the spun yarn end therein; and thereafter, resuming a normal spinning process.

3. The piecing method for a spinning machine as in claims 1 or 2, wherein the sinning part comprises an air spinning nozzle that produces a rotating air current by the internal blowing of compressed air and a spindle having a tip and yarn insertion holes and of which the tip is positioned inside the air spinning nozzle, and wherein said sliver portion of near normal fiber density is supplied after the spun yarn end has been inserted into the spindle and positioned inside the spinning nozzle.

4. The piecing method for a spinning machine as in claim 1, wherein the fiber density of said sliver portion is higher than the fiber density of the end of the removed broken sliver portion.

5. The piecing method for a spinning machine as in claim 4, wherein the length of the end of the sliver portion of near normal fiber density is shorter than the length of the end of the removed broken sliver portion.

6. The piecing method for a spinning machine as in claim 1, wherein the portion of broken sliver having a rough fiber density is removed in front of the spinning part.

7. The piecing method for a spinning machine as in claim 6 including the step of applying compressed air to a region between the spinning part and the draft part for blowing the portion of broken sliver of rough fiber density away from said region.

8. A piecing method for a spinning machine as in claim 7, wherein, after removal of said blown away sliver portion, the application of compressed air between the spinning part and the draft part is stopped before the sliver portion having a near normal fiber density is conducted to the spinning part.

* * * * *